US005412831A

United States Patent [19]

Mongelluzzo

[11] Patent Number: 5,412,831

[45] Date of Patent: May 9, 1995

[54] TOOTHBRUSH WITH REPLACEABLE BRUSH HEAD

[75] Inventor: Michael Mongelluzzo, Bayside, N.Y.

[73] Assignee: Mongelluzzo & Butta, Ltd., Manhasset, N.Y.

[21] Appl. No.: 197,739

[22] Filed: Feb. 17, 1994

[51] Int. Cl.[6] ..... A46B 9/01

[52] U.S. Cl. ..... 15/167.1; 15/176.4; 15/176.5; 15/176.1; 15/144.4

[58] Field of Search ..... 15/167.1, 167.2, 176.1–176.6, 15/201, 202, 145, 144.4, 143.3, 184, 244.1

[56] References Cited

U.S. PATENT DOCUMENTS

| | | | |
|---|---|---|---|
| 2,111,880 | 3/1938 | Waters | 15/176.6 |
| 2,668,973 | 2/1954 | Glaza et al. | 15/176.6 |
| 2,677,842 | 5/1954 | Sherwin | 15/176.1 |
| 2,893,031 | 7/1959 | Dengler | 15/176.4 |
| 5,144,712 | 9/1992 | Hansel et al. | 15/145 |

*Primary Examiner*—David A. Scherbel
*Assistant Examiner*—Gary K. Graham
*Attorney, Agent, or Firm*—Bauer & Schaffer

[57] ABSTRACT

A toothbrush with a replaceable head includes a tubular casing including an axial bore defining a longitudinal axis. A support member having first and second ends extends longitudinally into the axial bore of the tubular casing for movement along the longitudinal axis therein between a closed position and an open position. A limiting member is supported by the tubular casing for limiting the relative longitudinal movement of the support member within the tubular casing. A brush head is removably secured to the second end of the support member for connection and disconnection thereof when the support member is in the open position.

7 Claims, 2 Drawing Sheets

TOOTHBRUSH WITH REPLACEABLE BRUSH HEAD

FIELD OF THE INVENTION

The present invention relates generally to toothbrushes and, more particularly, to a toothbrush with a replaceable brush head.

BACKGROUND OF THE INVENTION

In the dental hygiene field, there exists toothbrushes including a brush head which is replaceable when the bristles of the brush head can no longer perform efficiently. Such toothbrush designs enjoy many advantages not present in conventional toothbrushes which do not provide for a replaceable brush head. Among these advantages include the ability to replace the brush head when the latter can no longer brush the teeth of a user efficiently, such as the bristles being rendered unusable from over use, without having to discard the entire toothbrush; and the ability to permit more than one user to utilize the same toothbrush by merely replacing a brush head with another when desired.

The prior art provides various forms of toothbrush devices. One prior art toothbrush device includes a handle portion having a brush end comprising a base portion having a series of longitudinal ribs and an upstanding shoulder at one end thereof. A replaceable brush head is provided including a base having an upper surface with bristles extending therefrom and a bottom surface including a series of slots receiving the ribs on the base portion. The brush head is retained on the base portion from becoming displaced in the longitudinal direction of the handle portion by the upstanding shoulder at one end and a detente extending from the other end of the brush head and into an opening in the base portion.

Another prior art toothbrush device includes an elongated handle portion and a brush head detachably received on the handle portion. The handle portion is provided with a longitudinally extending cavity at one end thereof and the brush head has a projection formed at one end thereof which is receivable in the cavity with a friction fit.

The disadvantages with above-mentioned prior art toothbrush devices is that brush heads are not firmly secured to the handle portion so as to overcome the excessive forces applied to the brush head during a brushing operation. The lack of a secure connection between the brush head and the handle portion may result in the former becoming disconnected from the latter, possibly destroying the toothbrush and rendering it unusable. Damage to the teeth of a user may also occur. Hence, such toothbrush devices are not simple to use and are generally not trouble free in operation.

The present invention overcomes many of the disadvantages inherent in the above-described toothbrush devices by providing an improved toothbrush including a tubular casing performing as a handle for the toothbrush, a support member extending longitudinally into the casing and a replaceable brush head supported at one end of the support member. The support member is permitted to move within the casing between a closed position, in which a user may perform a brushing operation, and an open position, in which the brush head may be replaced. A limiting member limits the movement of the support member from the closed position to the open position. The present invention provides a toothbrush with a replaceable brush head which is of simple construction and easy to use such that it is economically feasible, long-lasting and relatively trouble free in operation.

SUMMARY OF THE INVENTION

Briefly stated, the present invention is a toothbrush with a replaceable brush head. The toothbrush comprises a tubular casing including first and second ends and an axial bore defining a longitudinal axis, a support member having first and second ends and extending longitudinally into the tubular casing for movement along the longitudinal axis, means for limiting the relative longitudinal movement of the support member within the tubular casing, and a brush head removably supported by the second end of the support member. The limiting means limits movement of the support member between a closed position, in which a user may perform a brushing operation, and an open position, in which the brush head may be readily disconnected and reconnected from the second end of the support member.

BRIEF DESCRIPTION OF THE DRAWINGS

The foregoing summary, as well as the following detailed description of a preferred embodiment of the invention, will be better understood when read in conjunction with the appended drawings. For the purpose of illustrating the invention, there is shown an embodiment which is presently preferred. It being understood, however, that this invention is not limited to the precise arrangements and instrumentalities shown.

In the drawings.

DETAILED DESCRIPTION OF PREFERRED EMBODIMENT

While this invention is susceptible of embodiments in many different forms, this specification and the accompanying drawings disclose only some specific forms as examples of the use of the invention. The invention is not intended to be limited to the embodiment so described, and the scope of the invention will be pointed out in the appended claims.

Figure 1:
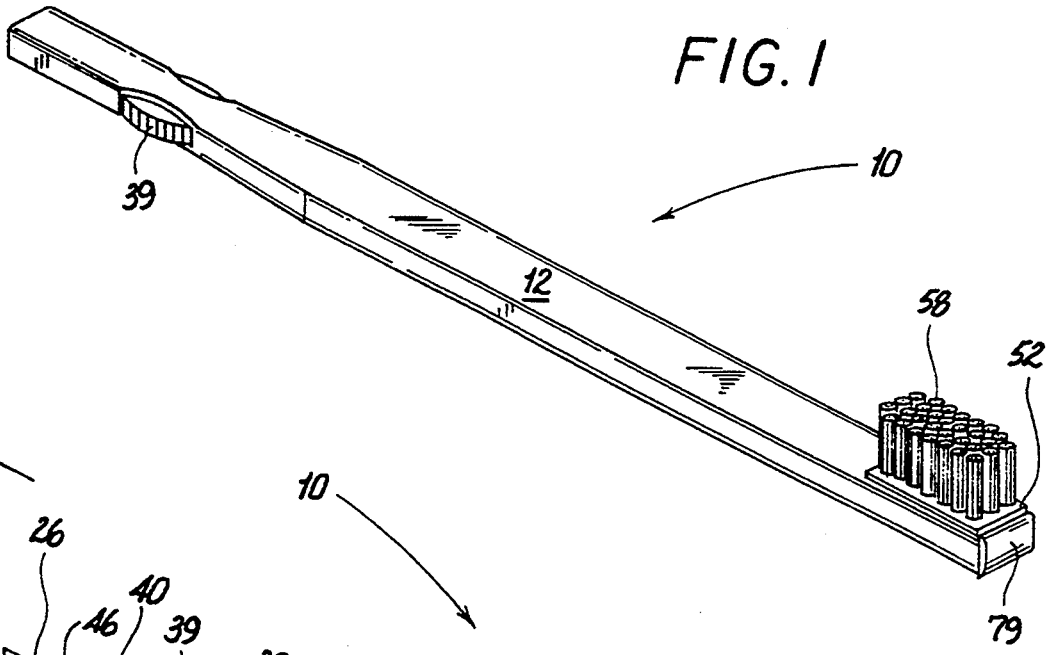
FIG. 1 is a perspective view of a toothbrush in accordance with the present invention in assembled position.

In the drawings, like numerals are used to indicate like elements throughout. A preferred embodiment of a, generally designated 10, toothbrush is shown in FIGS. 1–6. FIG. 1 depicts the toothbrush 10 in an assembled position and ready for use to brush a set of teeth. As further described below, the toothbrush 10 comprises four major components which, when assembled together, make up the preferred embodiment of the toothbrush shown in FIG. 1.

Figure 2:
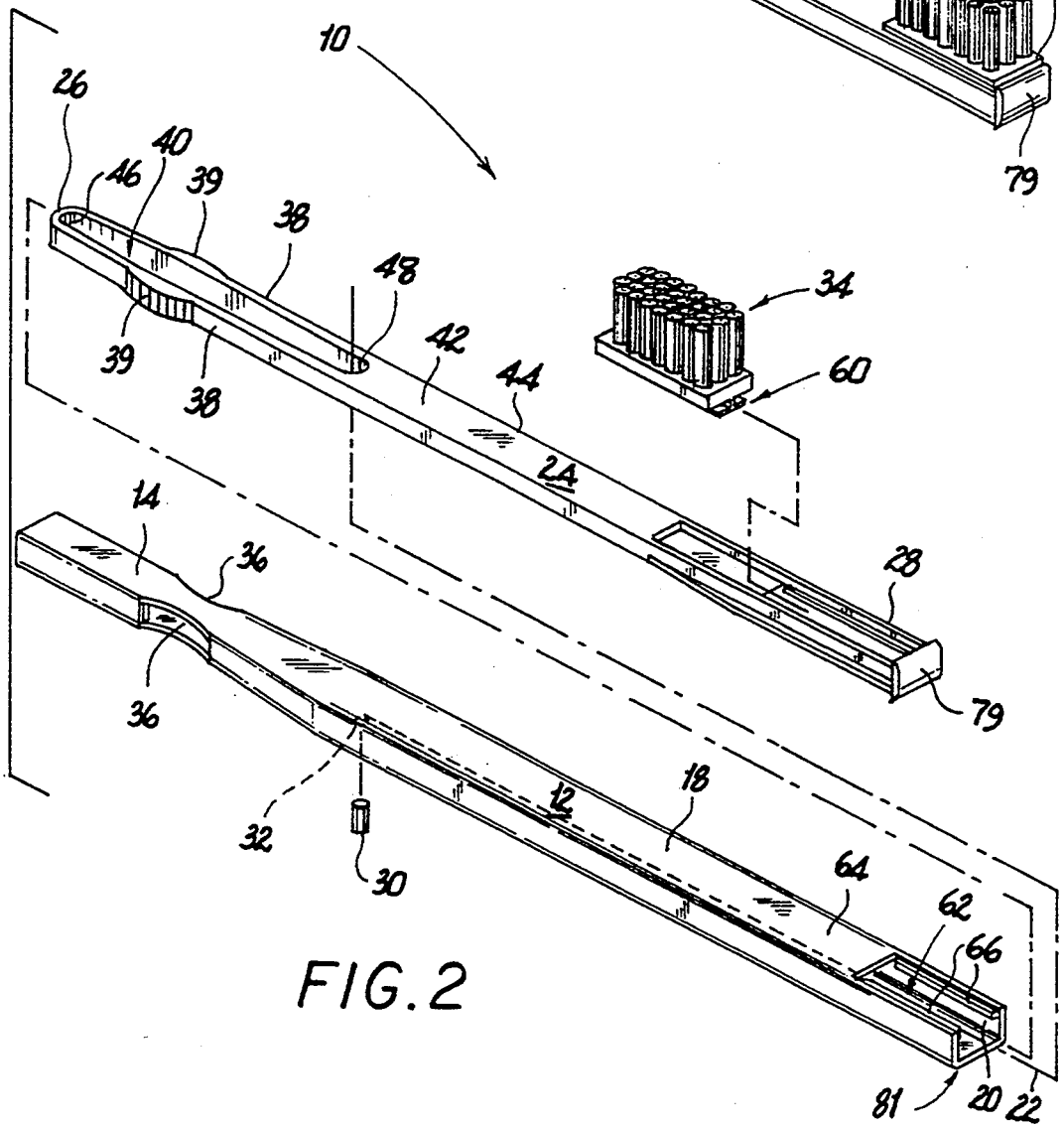
FIG. 2 is an exploded perspective view of the toothbrush depicting the tubular casing, the support member, the limiting means and the replaceable brush head.

As best shown in FIG. 2, the toothbrush 10 comprises an elongated tubular casing 12 including a first end 14, a second end 16, and an axial bore 18 having an inner surface 20 and defining a longitudinal axis 22. It will be appreciated by those skilled in the art that the elongated tubular casing 12 in the present invention serves as a handle for the toothbrush 10 when the latter is in the assembled position shown in FIG. 1.

An elongated support member 24 extends longitudinally into the axial bore 18 of the tubular casing 12 and includes a first end 26 and a second end 28. The support member 24 is correspondingly sized in relation to the axial bore 18 so as to allow movement of the former along the longitudinal axis 22 of the latter. Movement of the support member 24 within the tubular casing 12 is limited by a fastener 30 extending through an aperture 32 in the tubular casing and into the axial bore 18 as further described below. A brush head, generally designated 34, is removably supported by the second end 28 of the support member 24.

According to a preferred feature of the present invention, the first end 14 of the tubular casing 12 comprises diametrically opposed, longitudinally extending slots 36 communicating into the axial bore 18. The first end 26 of the support member 24 comprises externally accessible, manipulatable means adjacent the slots 36 for selectively moving the support member 24 within the tubular casing 12. Specifically, the manipulatable means include a pair of resilient arms 38 and an ear 39 extending from each arm and through a respective one of the longitudinal slots 36 in the tubular casing 12. The arms 38 define a longitudinal opening 40 extending from an upper surface 42 to a lower surface 44 of the tubular casing 12. The opening 40 includes first and second ends respectively defining abutment surfaces 46, 48. The opening 40 permits the flexible arms 38 to be simultaneously compressed towards the longitudinal axis of said tubular casing so as to allow the ears 39 to clear the slots 36 and thereby allow said support member 24 to be moved longitudinally within said tubular casing 12 as further described below.

Figure 3:
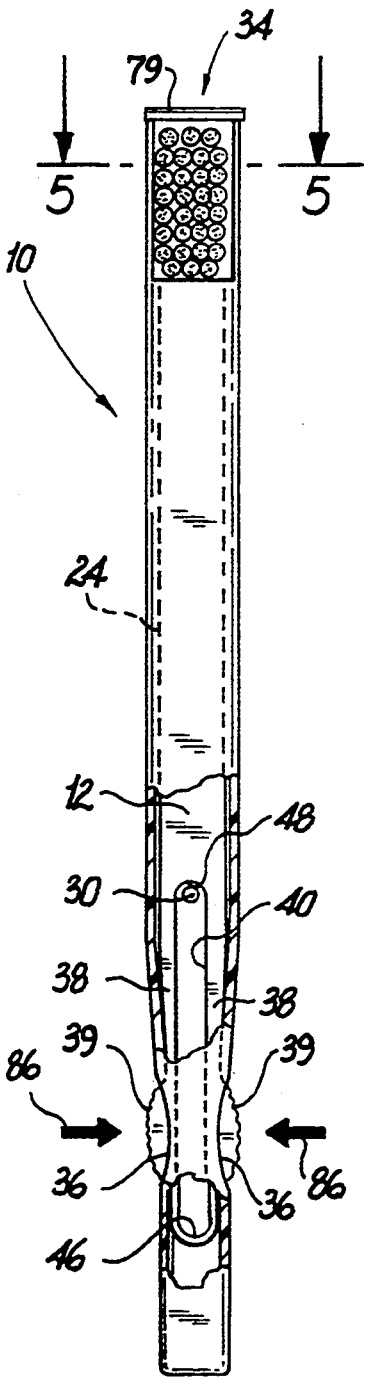
FIG. 3 is an elevational view, partially broken away, of the toothbrush of FIG. 1 in the closed position.
Figure 4:
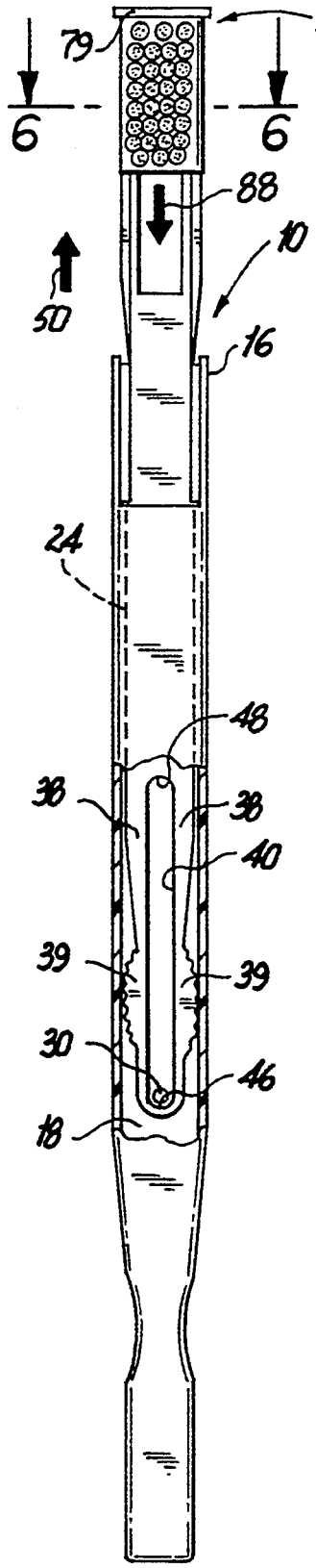
FIG. 4 is an elevational view, partially broken away, of the toothbrush of FIG. 1 in the open position.

Referring now to FIG. 2–4, the fastener 30 extends through aperture 32 in the tubular casing 12 and into the longitudinal opening 40 at the first end 26 of the support member 24. As shown in FIG. 3, the fastener 30 engages the abutment surface 48 at the second end of the opening 40 when the ears 39 extend radially outward through a respective one of the longitudinal slots 36 in the tubular casing 12. This configuration defines a closed position of the support member 24, in which the support member is securely locked in place and prevented from longitudinal movement within the tubular casing 12. In the closed position of the support member 24, the toothbrush 10 is ready to be used to perform a brushing operation.

In FIG. 4, the arms 38 and ears 39 have been operated on to move the support member along the axial bore 18 of the tubular casing until the fastener 30 engages the abutment surface 46 at the first end of the longitudinal opening 40. This configuration defines an open position of the support member 24, in which the support member is prevented from further longitudinal movement within the axial bore 18 in the direction shown by arrow 50. Hence, the fastener 30, arms 38, ears 39 and opening 40 operate to limit the relative movement of the support member 24 within the axial bore 18 between a closed position, in which the toothbrush is ready for use (FIG. 3), and an open position, in which a user has access to the removable brush head 34 (FIG. 4) as further described below.

Preferably, the tubular casing 12 and the support member 24 are constructed of a polymer by conventional molding processes. However, it is understood by those skilled in the art that other materials for the tubular casing and the support member are suitable. For example, the tubular casing 12 should preferably be formed from a non-elastic, hard material such as a rigid plastic material for long-lasting use. The support member should preferably be formed from an elastic, hard plastic material which allows for long-lasting use but permits the arms 38 to be compressed or flexed toward the opening 40 when moving the support member from the closed position (FIG. 3) to the open position (FIG. 4).

Preferably, the fastener 30 comprises a smooth pin mounted within the aperture 32 with a friction fit and molded from a non-elastic, hard material such as a rigid plastic. However, it is understood by those skilled in the art that other types of connectors, materials and fabrication methods are suitable for the fastener 30. For example, the fastener 30 could take the form of a partially threaded bolt threaded into aperture 32 and formed from a suitable metal such as steel.

Figure 5:
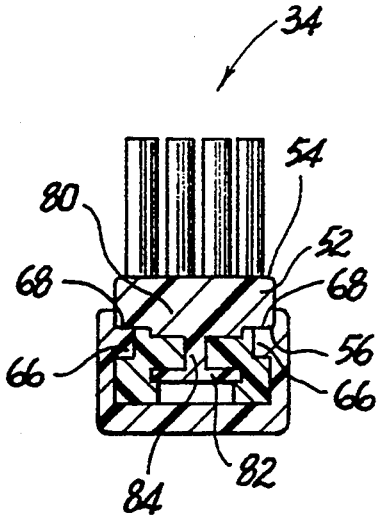
FIG. 5 is a cross-sectional view of the toothbrush shown in FIG. 3 taken along lines 5—5 of FIG. 3.
Figure 6:
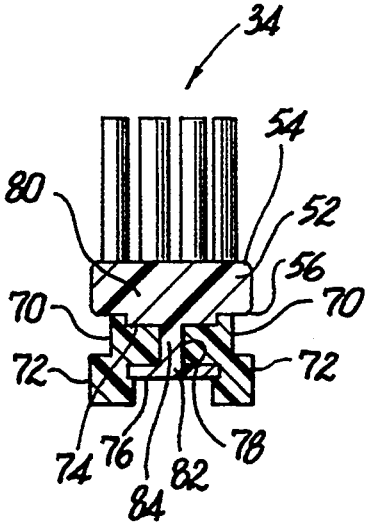
FIG. 6 is a cross-sectional view of the toothbrush shown in FIG. 4 taken along lines 6—6 of FIG. 4.

Referring now to FIG. 5 and 6, the brush head 34 includes a base 52 having an upper surface 54 and a lower surface 56. The upper surface 54 includes bristles 58 extending therefrom and the lower surface 56 includes a connecting member, generally designated 60 (FIG. 2), extending therefrom and removably supported by the second end 28 of the support member 24. As further detailed below, the brush head 34 is adapted, through its connecting member 60, for connection and disconnection from the second end 28 of the support member 24 when the support member is in the open position (FIG. 4).

The details of the material for the bristles and its manner of connection to the upper surface 54 of the base 52 are not pertinent to the invention and are well understood by those skilled in the art. Accordingly, further description thereof is omitted for purposes of convenience only and is not limiting.

FIG. 5 is a cross-sectional view along lines 5—5 in FIG. 3 illustrating the assembled condition of the brush head 34 in relation to the second ends of the tubular casing 12 and support member 24 when the support member is in the closed position. With reference also to FIG. 2, the second end 16 of the tubular casing 12 comprises an opening 62 at a top surface 64 thereof. The opening 62 is defined by the internal surface 20 of the axial bore 18. A pair of ribs 66 extend within the opening 62 from the internal surface 20 along a direction parallel to the longitudinal axis. As shown in FIG. 5, the ribs 66 define shoulders 68 providing supporting surfaces for the brushhead 34 when the support member 24 is in the closed position.

FIG. 6 is cross-sectional view along lines 6—6 in FIG. 4 depicting the removable connection between the brush head 34 and the second end 28 of the support member 24. The second end 28 of the support member 24 comprises a groove 70 extending from each side 72 along an outer surface thereof. Each of the grooves 70 complementary and releasably receive a respective rib 66 when the support member 24 is in the closed position (FIG. 5). The second end 28 further comprises an upper surface 74 defining a first sliding way and lower surface 76 defining a second sliding way. A passage 78 communicates the first sliding way 74 to the second sliding way 78. The sliding ways 74, 76 and the passage complementary and releasably receive the connecting member 60 of the brush head 34 as further described below. The second end 28 of the support member 24 is also provided with a closure plate 79 (FIG. 1 and 2) which effectively covers the distal portion 81 at the second end 16 of the tubular casing 12, thus preventing the axial bore 18 from contacting water, toothpaste or any other dental hygiene fluid material which may contaminate the toothbrush 10.

As best shown in FIGS. 5 and 6, the connecting member 60 comprises an upper retaining element 80 connected to a lower retaining element 82 by a web portion 84. Thus, when the brush head 34 is releasably connected to the second end 28 of the support member 24, the upper retaining element 80 engages the first sliding way 74, the lower retaining element 82 engages the second sliding way 76 and the web portion 84 extends through the passage 78.

In use, the toothbrush 10 shown in FIG. 1 may be utilized to brush the teeth of a user in a conventional manner as is recognized in the art, with the tubular casing 12 serving as a handle portion. In this condition, the toothbrush 10 is in a closed position with the brush head 34 securely in place. When it is desired to remove the brush head 34 for cleaning or replacement purposes, the ears 39 are simultaneously compressed in the direction shown by arrows 86 in FIG. 3 until the ears clear the slots 36. The ears are subsequently pushed upward in the direction shown by arrow 50 in FIG. 4 until they engage the interior surface 20 in the axial bore 18. The support member 24 is then moved in the direction 50 by pulling from the second end 28 thereof, or by merely grasping the brush head, until the fastener 30 engages the abutment 46 at the first end of the longitudinal opening 40. At this point, the fastener 30 prevents any further longitudinal movement of the support member 24 within the axial bore 18, thus achieving its open position (FIG. 4).

Removal of the brush head 34 is accomplished by sliding the same in the direction shown by arrow 88 in FIG. 4 until the connecting member 60 disengages from the sliding ways 74, 76 and the passage 78 at the second end 28 of the support member 24. Replacement of the brush head 34 is accomplished by performing the reverse operation. After the brush head has been properly secured to the second end 28, the support member is pushed into the axial bore 18 in the direction opposite shown by arrow 50 in FIG. 4 until each ear 39 snaps into a respective slot 36 against the bias of the flexible arms 38. At this point, the fastener 30 engages the abutment 48 at the second end of the opening 40 and prevents further movement of the support member 24 within the axial bore 18. The support member 24 is again in a closed position and the toothbrush 10 is once again ready for use.

From the foregoing description, it can be seen that the present invention comprises an improved toothbrush with a replaceable brush head which is of simple construction, easy to use, long-lasting and relatively trouble free in operation. It will be appreciated by those skilled in the art that changes could be made to the embodiment described above without departing from the broad inventive concept thereof. It is understood, therefore, that this invention is not limited to the particular embodiment disclosed, but is intended to cover modifications within the spirit and scope of the present invention as defined by the appended claims.

What is claimed is:

1. A toothbrush comprising:

(a) a tubular casing including first and second ends and an axial bore having an internal surface and defining a longitudinal axis;

(b) a support member having first and second ends and extending longitudinally into said tubular casing for movement along said longitudinal axis therein between a closed position and an open position;

(c) means supported by said tubular casing for limiting the relative longitudinal movement of said support member within said tubular casing to movement between said closed and open positions; and (d) a brush head including a base having upper and lower surfaces, said upper surface having bristles extending therefrom, said lower surface having a connecting member extending therefrom, said brush head being removably supported by said second end of said support member, said brush head being adapted for connection and disconnection from said second end of said support member when said support member is in said open position.

(e) said second end of said tubular casing comprises an opening at a top surface thereof defined by said internal surface and a pair of ribs extending within said opening from said internal surface, said ribs extending into said axial bore from said second end of the tubular casing along a direction parallel to said longitudinal axis, each of said ribs defining a shoulder partially supporting said brush head when said support member is in said closed position.

2. The toothbrush of claim 1 wherein said second end of said support member comprises:

(a) a pair of longitudinal grooves extending along an outer surface thereof, said grooves receiving said ribs when said support member is in said closed position;

(b) an upper surface defining a first sliding way and a lower surface defining a second sliding way; and (c) a passage communicating said first and second sliding ways.

3. The toothbrush of claim 2 wherein said connecting member in said brush head comprises an upper retaining element connected to a lower retaining element by a web portion, said upper retaining element engaging said first sliding way, said lower retaining element engaging said second sliding way and said web portion extending through said passage.

4. The toothbrush of claim 1 wherein:

said first end of said tubular casing comprises diametrically opposed, longitudinally extending slots communicating into said axial bore; and said first end of said support member comprises externally accessible, manipulatable means adjacent said slots for selectively moving said support member within said axial bore of said tubular casing from said closed position to said open position.

5. The toothbrush of claim 4 wherein said manipulatable means comprises:

(a) a pair of resilient arms defining a longitudinal opening including first and second ends defining abutment surfaces, said opening permitting said arms to be compressed towards said longitudinal axis of said tubular casing; and (b) an ear extending from each of said arms and radially outward through a respective one of said longitudinal slots in said tubular casing, whereby upon simultaneous compression of said arms towards said longitudinal axis said longitudinal opening permits said ears to clear said longitudinal slots and said support member is permitted to be moved from said closed position to said open position.

6. The toothbrush of claim 5 wherein said limiting means comprises:

(a) an aperture extending from a lower surface of said tubular casing and communicating with said axial bore and said longitudinal opening in said support member; and (b) a fastener extending through said aperture and into said longitudinal opening in said support member, said fastener engaging said abutment surface at said first end of said longitudinal slot when said support member is in said open position and said fastener engaging said abutment surface at said second end of said longitudinal slot when said support member is in said closed position.

7. The toothbrush of claim 6 wherein said fastener comprises a pin supported in said aperture with a friction fit.

* * * * *